United States Patent [19]

Huang et al.

[11] Patent Number: 4,971,200

[45] Date of Patent: Nov. 20, 1990

[54] PACKAGING SYSTEM FOR STRING LIGHTS

[76] Inventors: Chen-Hsien Huang, 22,46 Alley, 486 Lane, Ming Hu Road; Chia-Ho Chen, 15, 100 Lane, Pu Ting Road, both of Hsin Chu, Taiwan

[21] Appl. No.: 419,200

[22] Filed: Oct. 10, 1989

[51] Int. Cl.[5] ..... B65D 85/42; B65D 21/02

[52] U.S. Cl. ..... 206/420; 206/504; 206/509; 220/23.4; 362/249

[58] Field of Search ..... 211/26, 60.1, 89; 362/249, 806, 252; 206/419–422, 504, 509; 220/23.2, 23.4, 23.6, 23.8

[56] References Cited

U.S. PATENT DOCUMENTS

| | | | |
|---|---|---|---|
| 2,984,347 | 5/1961 | Kalinchuk | 206/419 |
| 3,431,548 | 3/1969 | Busler | 220/23.4 |
| 3,685,687 | 8/1972 | Eckdahl | 206/509 X |
| 3,734,309 | 5/1973 | Bateman | 206/509 X |
| 3,760,937 | 9/1973 | Van Wyngarden et al. | 206/504 X |
| 3,811,566 | 5/1974 | Bateman | 206/509 |
| 4,043,477 | 8/1977 | Deese | 220/23.4 |
| 4,769,749 | 9/1988 | Felski | 362/249 X |

FOREIGN PATENT DOCUMENTS

| | | | |
|---|---|---|---|
| 205911 | 12/1959 | Austria | 220/23.4 |
| 2727461 | 1/1979 | Fed. Rep. of Germany | 220/23.4 |
| 2006304 | 12/1969 | France | 206/419 |

*Primary Examiner*—Bryon P. Gehman

*Attorney, Agent, or Firm*—Knobbe, Martens, Olson & Bear

[57] ABSTRACT

A series of lights are mounted in side-by-side relation on a plastic support module. A second module is partially positioned in overlapping relation with the first module and a pair of holes on the second module are positioned onto the upper ends of a pair of posts on the first module, with the electrical wires of the lights on the first module being clamped between the overlapping module areas.

18 Claims, 3 Drawing Sheets

PACKAGING SYSTEM FOR STRING LIGHTS

BACKGROUND OF THE INVENTION

The present invention pertains to a space-saving packaging system for strings of lights.

Conventional means for packaging light strings includes the use of styrofoam boxes and molded plastic sheets. Styrofoam boxes, molded with a prescribed number of separate compartments, aline the lights in several long rows. The packager inserts the lights into the individual compartments coiling the string of wire between the rows. The plastic sheets similarly hold a prescribed number of lights individually in place using molded tabs. The lights are laid in long rows with the string of wire, coiled between these rows.

Several problems currently plague these conventional packaging means. First, they are difficult to package. Both means loosely coil the string of electrical wire between the rows of lights. These loose coils tend to move about during the packaging process thereby further complicating the packaging procedure.

Second, the conventional means wastes packaging space. With lights individually held in long rows laid side by side and the string of wire coiled in between these rows, these forms of packaging tend to occupy a large horizontal area. Such form of packaging further does not reduce its vertical dimension as dimension is dictated by the height of the electrical plug. Accordingly, these forms of packaging do not minimize their cubic packaging volume.

Finally, both are restricted to a prescribed number of lights in the string. Accordingly, the packager must keep on hand several sizes of these packaging means to accommodate the packaging of light strings containing a different number of lights in a string, for example 35, 50, or 100 bulbs in a string.

SUMMARY OF THE INVENTION

An apparatus is provided for the packaging of light strings, wherein a module holds a number of light. The module may be attached with a like module such that the assembly clamps the coiled wire extending from the lights held by the lower module. Securing the coils of wire in this manageable position thereby eases the packaging operation.

A plurality of modules may be stacked and attached in an over-lapping row to reduce their combined stacking height. Assembling in this shingle-like manner, the wires extending from the lights held by the lower module are integrated into the structural assembly to support the upper module along a portion of its base. The upper module is thereby positioned at an angle relative to the lower module. When a third module is attached in the same manner to the upper module, an overlapping assembly is thus formed. A plurality of modules assembled in such a fashion reduces the space needed for packaging and eases the packaging operation.

The degree of overlap between the modules dictates the height of the assembly. The minimum cubic packaging volume is obtained by overlapping the rows such that their combined height is about the width of a standard electrical plug, as this dimension controls the minimal vertical parameter of the packaging. This dimension is approximately equivalent to the height of three modules stacked vertically.

Any number of modules may be combined to accommodate a variety of light strings differing in the number of lights contained in the string. Therefore, the packager need only stock the one type of module to package light strings with varying number of lights.

DESCRIPTION OF THE PREFERRED EMBODIMENT

Figure 1:
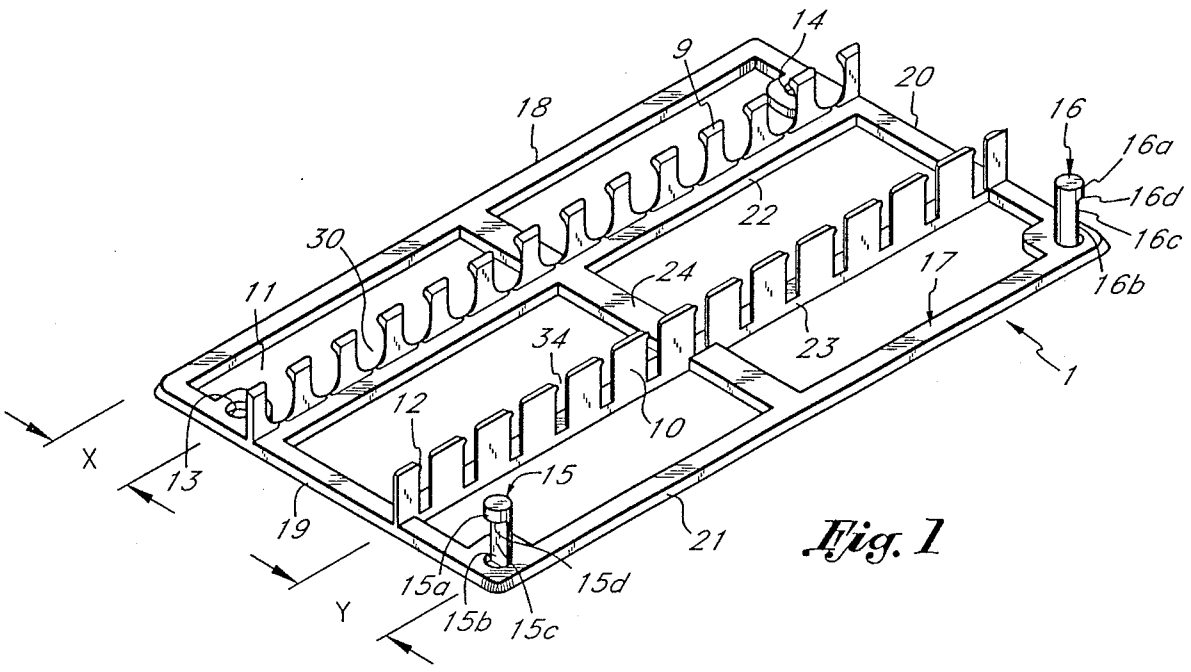
FIG. 1 is a perspective view of the invention.

Shown in FIG. 1 is a module comprising a supporting base or frame 17 having a generally rectangular shape. The outer periphery of the frame is formed by a forward strut-like member 18 spaced from and substantially parallel to a rear strut-like member 21, and joined by a pair of strut-like side members 19 and 20. The frame 17 further includes a rib 22 spaced from a rib 23, with both ribs extending substantially parallel to the struts 18 and 21. The ribs 22 and 23 are further supported by a rib 24 extending parallel to the side struts 19 and 20.

Figure 2:
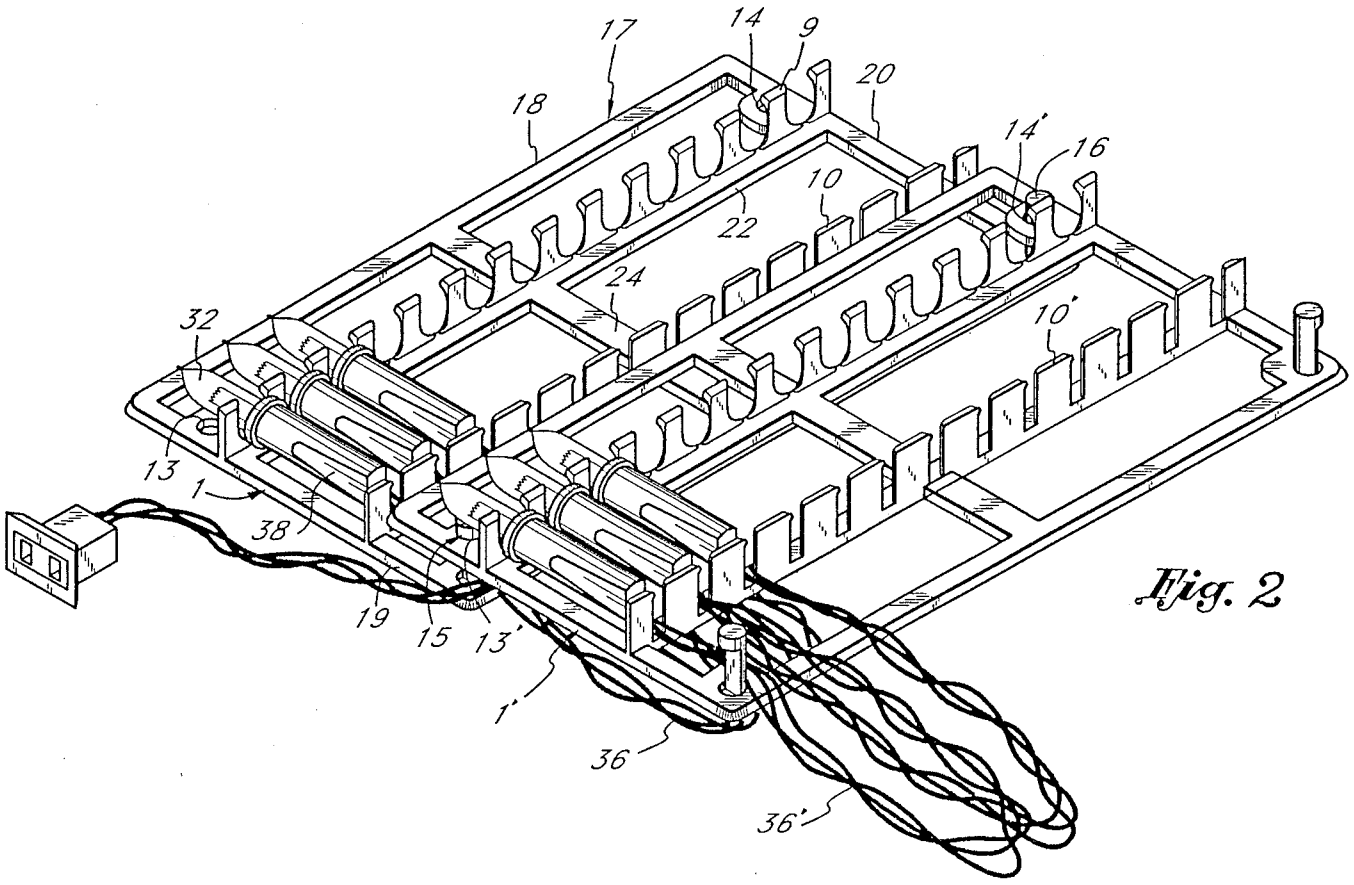
FIG. 2 is a perspective view showing the invention in operation.
Figure 3:
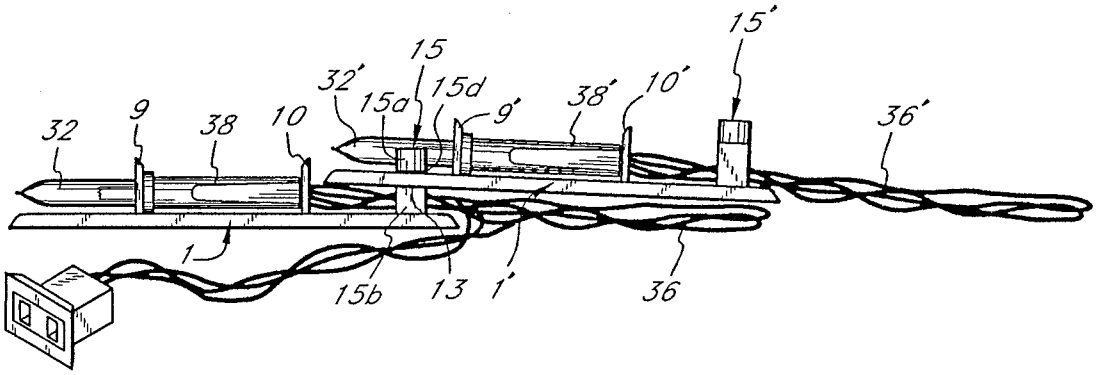
FIG. 3 is a side-elevation of the invention in operation.

The rib 22 supports a plurality of upwardly extending, spaced fingers which form light bulb holders 9 arranged in a row 11. The space 30 between each adjacent pair of fingers is adapted to receive a single light bulb 32, as seen in FIGS. 2 and 3. The rib 23 supports a plurality of vertically extending wire holders be arranged in a row 12, with the space 34 between each pair of holders being adapted to receive the wires 36 extending from each bulb. The center line of each light bulb holder space 30 is approximately aligned with the center line of each wire holder space 34. The distance between the rows 11 and 12 is slightly greater than the length of a fixture 38 supporting the bulb 32, such that this fixture is positioned between the rows 11 and 12, as seen in FIGS. 2 and 3.

A pair of spaced, vertically extending posts 15 and 16 are positioned symmetrically on the corners of the frame 17 formed by the side struts 19 and 20 and the rear strut 21, which is on the wire side of the module. Further, it can be stated that the posts are between the outer edge of the strut 21 and the row of wire holders 12. Holes 13 and 14 are symmetrically positioned in the frame struts 19 and 20 on the bulb side of the module, and between the leading strut 18 and the row 11 of light bulb holders 9. The placement of the holes 13 and 14 and the posts 15 and 16 is such that the distance X between the center line of the holes 13 and 14 and the outer edge of the strut 18 is less than the distance Y between the center line of the posts 15 and 16 and the row of wire holders 12.

The module 1, with all its elements, is preferably formed using conventional plastic molding processes into a one-piece component. Preferably, the plastic employed is stiff but yet somewhat flexible so that a bulb 32 can be snapped into the light bulb holder 9 and will be retained there by frictional fit, separated from an adjacent bulb.

As best seen in FIG. 1, the posts 15 and 16 have a cylindrical shape at their top portions **15*a* and 16*a*. At a short distance from the upper surface of the posts and extending downwardly to the frame struts is a portion 15*b* and 16*b* having generally a semi-cylindrical cross-section. Thus, there is essentially formed a notch or relief 15c and 16c, with a shoulder 15d and 16d being formed at the intersection between the upper cylindrical portion 15a and 16a and the lower semi-cylindrical portion 15b and 16b. The notches 15c and 16c** both face outwardly away from the opposing post.

In use of the module in packaging lights, a string of lights is positioned, as illustrated in FIG. 2, wherein it can be seen that a light bulb 32 is snapped into a light holder 9 with the tubular light fixture 38 extending between the light holders 9 and the wire holders 10, and with the wire 36 extending through the wire holder 10. A series of bulbs 32 are positioned in side by side relation with the wires 36 of a group of adjacent bulbs being neatly coiled adjacent to the wire holders, with the coils extending beyond the rear strut 21.

After one module is filled in this fashion, a second, upper module 1' is positioned above the lower module 1 with the leading portion of the upper module extending over the rear portions of the lower modules 1 in overlapping or shingle fashion. The holes 13 and 14 of the upper module 1' are aligned with and snapped onto the posts 15 and 16 of the lower module 1. The diameter of the posts is slightly larger than the diameter of the holes so that a friction fit is obtained. Also, the distance between the center line of the posts may be slightly less than the distance between the center line of the holes. Consequently, once the upper module is snapped onto the lower one, the shoulders 15d and 16d on the posts of the lower module tend to engage the upper surface of the upper module frame to thereby keep the modules assembled or latched together such that the frame of the upper module does not slip off the posts of the lower module. The height of the notches 15c and 16c thus limits the separation of two assembled modules. In this position, the frame member 18, of the upper module 1' clamps the coils 36 extending from the lights supported by the lower module.

A series of light bulbs 32 are attached to the upper module 1, in a fashion similar to that described for the lower module 1. Alternatively, the lights for the upper module 1, can be assembled to it before the upper module is attached to the lower module.

As best seen in FIG. 3, the wires of the lower module support the leading portion of the upper module, and the rear portion of the upper module angles downwardly at an angle relative to the lower module frame rather than parallel to it. When a third module is attached to the upper module in a manner similar to that described above, a shingle-like assembly is formed with the modules being integrated as a single packaging assembly and with the wires of one module supporting the leading portion of the adjacent module. The modules overlap about one thread and thus the effective horizontal dimension of each module is only about two-thirds the length of the side struts of a module. Since the wires of the string of lights of one module extend essentially completely under the adjacent upper module, each module filled with lights, including the wires, is overlapped to about two-thirds of its dimension by the module above it. The rearward-most module of a group of modules of course does not have its wires overlapped. Similarly, the leading module, as seen in FIG. 3, does not have its lights in an overlapped arrangement.

With this arrangement, it can be seen that the height or vertical thickness of the stack is less than the height of three of the modules. Advantageously, the thickness of an assembly of overlapped or shingle-like modules is not much thicker than the electrical plug for the string of lights such that the thickness of a relatively flat box for containing an assembly of a string of lights is about the same as the thickness of the box that would be employed for a single layer of bulbs. Thus, it can be seen that the overlapping of the modules in the manner described minimizes their cubic packaging volume.

Another advantage of the arrangement is that no other packaging material is required in that the resilient wires together with the bulb holders satisfactorily support the individual bulbs to prevent breakage.

While the modules are shown in a particular size, they can be made smaller or larger as desired However, modules may be attached in side-by-side relation by suitable means if an increase in the number of modules in that direction is desired. Preferably, only a single size module is utilized with the modules being assembled to create the desired packaging size. This minimizes the manufacturing expense.

I claim:

1. A space saving system for packaging strings of lights, comprising:

a lower module and an upper module, each including a support having a forward edge and a rear edge spaced from its forward edge;

each module including a plurality of light holders on its support for securing a number of lights in a row adjacent its forward edge with electrical wiring for the lights extending towards its rear edge; and each module including a latching means for physically attaching said modules, including a first latch element near its forward edge and a second latch element near its rear edge, said elements being located and sized such that when the forward edge of said upper module overlaps the rearward edge of said lower module, said upper module first latch element is adapted to be attached to said second latch element of said lower module to confine between the modules the wiring extending from lights held by said light holders of the lower module.

2. A space-saving system for packaging light strings as defined in claim 1, wherein said upper module overlaps only about one-third of said lower module.

3. The system of claim 1 comprising:

a plurality of wire holders on each of said module supports positioned between said edges on each support for securing wireing extending from lights supported by said light holders.

4. A system as defined in claim 3, wherein said first latch element on said upper module snaps together with said second element of said lower module.

5. A module used for packaging strings of lights, comprising:

a base having a forward edge and a rear edge spaced from said forward edge;

a row of light holders supported by and extending upwardly from said base, each of said light holders comprising a structure to hold a light in a secure position; and a pair of spaced posts supported by said base positioned adjacent to one of said edges, said posts each having a lower end attached to said base and each having a free standing upper end adapted to fit within holes of a second module; and a pair of holes in said base adjacent the other one of said edges and adapted to receive posts of a third module.

6. A module as defined in claim 5, further comprising a plurality of wire holders for securing wires extending from lights held by said light holders, said wire holders forming a row positioned within said module symmetric to said row of light holders.

7. A module as defined in claim 5, wherein the posts and holes are positioned within said module such that when said module is attached to a second module by inserting said posts into holes of such second module, said modules clamp a plurality of loose coils of wire extending from lights held by said light holders.

8. A module as defined in claim 7, wherein said module is a one-piece component.

9. A module used for packaging strings of lights comprising:

a frame of generally rectangular shape having a forward member substantially parallel to a rear member, and separated by a pair of side members;

a row of light bulb holders on said frame between and generally parallel to said forward and rear members for holding a row of lights in a secure position;

a row of wire holders comprising structure for securing in a set position electrical wires extending from said lights;

a post on each of said frame side members adjacent to one of said forward and rear members; and a hole in each of said side members adjacent the other of said forward and rear members, each of said holes being sized to forward and rear members, each of said holes being sized to frictionally receive one of said posts.

10. A module as defined in claim 9, wherein said holes are positioned between said row of light bulb holders and said forward member, and said posts are positioned between said row of wire holders and the rear edge of said rear member.

11. A module as defined in claim 16, wherein said row of wire holders is spaced from the rearward edge of said rear member, and said holes are spaced from the forward edge of said forward member, and the spacing between said row of wire holders and said posts is greater than the spacing between said holes and said forward member, such that when two modules are attached, by inserting posts of a lower module into holes of an upper module, said forward member of said upper module confines between such upper and lower modules a plurality of wire coils extending from said row of wire holders of said lower module.

12. A module as defined in claim 11, wherein each of said posts has a relief is its cross section spaced from its post top, said relief creates a downwardly facing shoulder on each of said posts.

13. A module capable of attaching with like modules, comprising:

a base;

one or more posts supported by said base, and one or more holes in said base, said holes each having a cross section slightly smaller than the cross section of a respective one of said posts;

said posts and said holes being positioned in said module, and said module being of such material, that two of such modules may be attached to each other by forcibly inserting said posts of a lower module into corresponding holes of an upper module with said upper module overlapping said lower module, each of said posts having a relive in its cross-section spaced from its post top, said relief creating a shoulder on each of said posts.

14. A module as defined in claim 13, wherein the relief in each of said posts comprises a notch, with a notch in one of said posts being oriented opposite from that of the notch in another one of said posts.

15. A packaging system for strings of lights, comprising:

a first support module, a series of lights, each light including a bulb, a bulb fixture supporting the bulb and a coil of electrical wire connecting each bulb of said series, said bulb and said fixture for each of said lights being supported in side-by-side relation on said module with the coils of said lights extending in side-by-side relation; and a second support module, a second series of lights, each light of said second series including a bulb, a bulb fixture and a coil of electrical wire connecting the bulbs of said second series of lights, the bulb and bulb fixture of each of said second series of lights being supported in side-by-side relation on said second module, said modules including means interconnecting the modules, with the bulbs of said second module overlying and being supported by the coils of the first module.

16. The system of claim 15, wherein said modules include a pair of interconnecting holes and posts for securing said modules together in overlapping relation.

17. The system of claim 16 including a pair of spaced posts on said first module positioned on opposite sides of the coils of wire mounted on said first module, and said second module having a pair of spaced openings adjacent the bulbs of the second module on the upper ends of the posts on said first module.

18. A method for reducing packing space of light strings, comprising the steps of:

placing lights in side-by-side relation in light holders of a first support module;

coiling electrical wire connected to said lights and placing said wire adjacent to said lights on said module; and placing a second, like module so that a forward portion of said second module overlaps a rearward portion of said first module and clamping said wire between said modules by latching the modules together overlapping a portion of said first module with said second module.

* * * * *